US010741000B2

(12) United States Patent
Nicol et al.

(10) Patent No.: US 10,741,000 B2
(45) Date of Patent: Aug. 11, 2020

(54) RECYCLING MULTIPLE NOTES FROM A CASSETTE

(71) Applicant: NCR Corporation, Duluth, GA (US)

(72) Inventors: Craig Scott Nicol, Inchture (GB); Graeme Smith, Dundee (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/940,717

(22) Filed: Mar. 29, 2018

(65) Prior Publication Data

US 2019/0304232 A1 Oct. 3, 2019

(51) Int. Cl.

| | |
|---|---|
| ***G07D 11/16*** | (2019.01) |
| ***G07D 11/50*** | (2019.01) |
| ***G07D 11/12*** | (2019.01) |
| ***G07F 19/00*** | (2006.01) |
| ***G07D 11/30*** | (2019.01) |
| ***G07D 11/20*** | (2019.01) |
| ***G07D 11/24*** | (2019.01) |
| ***G07D 11/18*** | (2019.01) |

(52) U.S. Cl.

CPC ..... *G07D 11/16* (2019.01); *G07D 11/12* (2019.01); *G07D 11/18* (2019.01); *G07D 11/20* (2019.01); *G07D 11/24* (2019.01); *G07D 11/30* (2019.01); *G07D 11/50* (2019.01); *G07F 19/203* (2013.01)

(58) Field of Classification Search

CPC ..... B07C 5/34; B07C 5/3412; B07C 5/36; B07C 5/362; G07F 19/202; G07F 19/203; G07D 11/0096; G07D 11/16; G07D 11/18; G07D 11/50

USPC ..... 209/534; 194/206, 207; 902/9, 12, 13

See application file for complete search history.

(56) References Cited

U.S. PATENT DOCUMENTS

| | | | | |
|---|---|---|---|---|
| RE30,773 | E * | 10/1981 | Glaser | G06Q 40/02 235/379 |
| 8,229,816 | B1 * | 7/2012 | Mattison | G06Q 20/10 194/200 |
| 8,689,962 | B2 * | 4/2014 | Mizoro | G07D 11/50 194/206 |
| 8,733,531 | B2 * | 5/2014 | Iwamura | B65H 29/006 194/206 |
| 9,141,876 | B1 * | 9/2015 | Jones | G06K 9/60 |
| 9,558,418 | B2 * | 1/2017 | Jones | G06K 9/60 |
| 9,633,500 | B1 * | 4/2017 | Blake | G07D 3/16 |
| 9,704,322 | B2 * | 7/2017 | Ino | G07C 9/00166 |
| 2008/0301049 | A1 * | 12/2008 | Dyson | G07F 19/20 705/42 |
| 2013/0041809 | A1 * | 2/2013 | Ino | G07C 9/00166 705/39 |

* cited by examiner

*Primary Examiner* — Joseph C Rodriguez

(74) *Attorney, Agent, or Firm* — Schwegman, Lundberg & Woessner

(57) ABSTRACT

Disclosed are systems and methods for recycling currency. The systems and methods may include receiving, at a self-service terminal, a plurality of currency notes; sorting, by the self-service terminal, the plurality of currency notes by denomination; and dispensing, by the self-service terminal, a subset of the plurality of currency notes.

17 Claims, 3 Drawing Sheets

RECYCLING MULTIPLE NOTES FROM A CASSETTE

SUMMARY

Disclosed are systems and methods for recycling currency. The systems and methods may include receiving, at a self-service terminal, a plurality of currency notes; sorting, by the self-service terminal, the plurality of currency notes by denomination; and dispensing, by the self-service terminal, a subset of the plurality of currency notes.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention any manner.

DETAILED DESCRIPTION

Figure 1:
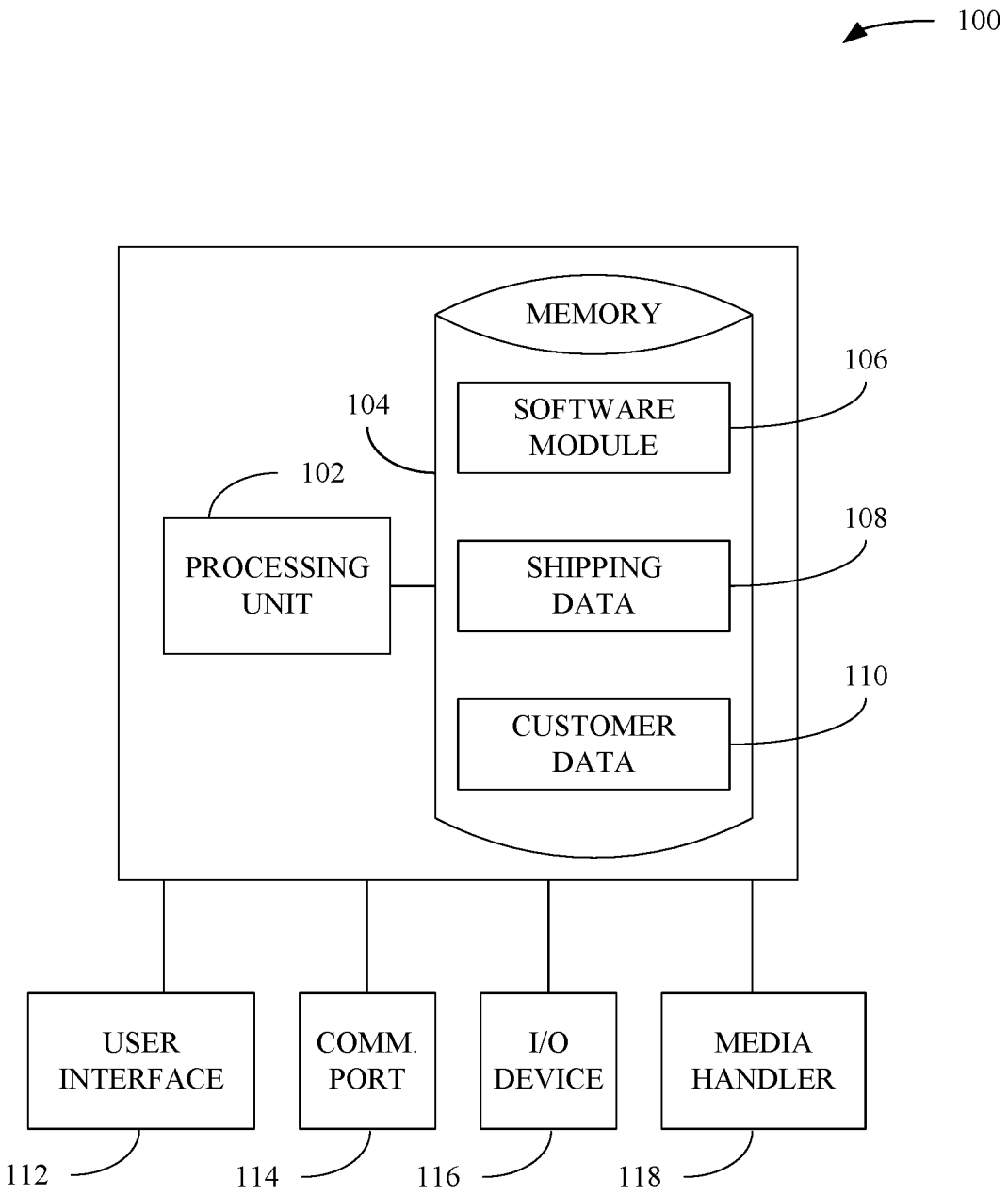
FIG. 1 shows an example schematic of a self-service terminal consistent with this disclosure.

The following detailed description refers to the accompanying drawings. Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the discloses systems. Accordingly, the following detailed description does not limit this disclosure. Instead, the proper scope of any invention disclosed herein is defined by the appended claims.

Currently, self-service terminals (SSTs) are able to accept and dispense currency notes. In doing so each denomination to be dispensed is loaded into separate cassettes. For example, there is one cassette that contains $10 bills, one cassette that contains $20 bills, etc. for each denomination to be dispensed. Any accepted currency notes are placed in a receiving cassette for later separation by bank personnel. Having a cassette for each denomination may require a large footprint for SSTs depending on the number of denominations to be dispensed.

As disclosed herein, a single cassette may be used to dispense multiple denominations instead of a single denomination. Thus, the number of cassettes needed by SSTs or other currency dispensing machines may be reduced. The reduction in the number of cassettes may result in a smaller footprint for the SSTs. In addition, the reduced number of cassettes may minimize maintenance, decrease costs associated with building and operating the SSTs, etc.

As disclosed herein, a single cassette may be able to dispense multiple currency denominations. This dispensing of multiple currency denomination is accomplished without hand sorting of currency by a person or partitioning of a cassette. Partitioning of a cassette is inefficient because space is wasted when a partition is not usable for a given denomination. For example, if a cassette is partitioned to hold $10 bills and $20 bills, once the $20 partition is full, the cassette is no longer able to accept $20 bills and a second cassette may be needed. As disclosed herein, $10 and $20 bills may be mixed together such that the cassette can accept both $10 and $20 bills without regard to a partition.

As disclosed herein, a single cassette may be used to recycle multiple denominations by storing in a memory a note stack stored in the cassette. Stated another way, as notes are stored in a cassette, the SST may store the denomination as the notes are stored. Thus, the SST knows the denomination order within the cassette and can dispense notes accordingly. The order of the notes can be known because the notes were either loaded into the cassette before it was placed in the SST or as notes are received the note stack can be adjusted to record newly added notes.

As disclosed herein, when customer requests an amount currency be dispensed, the SST may dispense currency based on an applicable mix of notes within a cassette. To do this, the SST may utilize the note stack, which is an indexed listing of notes within a cassette, to pick currency notes from the top of the bunch in a cassette down to the last note required. This indexed list of notes, the note stack, states where that note should go, e.g., a consumer interface prepresent position or a purge position. After the notes are taken by the customer, the notes in the purge location may be sent back to the cassette for later use. Should a misrecognition happen (e.g. double pick), a subsequent indexed list can be sent to make up the shortfall (i.e., the misrecognized note(s) would go to the purge position).

FIG. 1 shows an example schematic of a self-service terminal (SST) 100 consistent with this disclosure. As shown in FIG. 1, SST 100 may include a processing unit 102 and a memory 104. Memory 104 may include a software module 106, note stack data 108, and transaction data 110. While executing on processing unit 102, the software module 104 may perform processes for recycling notes, including, for example, one or more stages included in a method 300 described below with respect to FIG. 3. SST 100 may also include a user interface 112, a communications port 114, an input/output (I/O) device 116, and a media handler 118.

As disclosed herein, note stack data 108 may include a listing of the notes within cassettes of SST 100. The listing may be a database storing the denomination of each note within SST 100. The listing may be a linked list with each node of the list containing information about a note, such as its denomination, serial number, date/time it was added to a cassette, etc.

When a cassette is first installed into SST 100, note stack data 108 may be uploaded to memory 104. As transactions are carried out by SST 100, note stack data 108 may be updated as disclosed herein to reflect notes that are deposited to or withdrawn from SST 100. For example, when the cassettes are installed in media handler 118, one of the cassettes may contain 250 $20 bills and 250 $10 bills intermixed with one another. In other words, the notes in one of the cassettes may be $20-$10-$20-$10, etc. During a first transaction, a $5 bill and a $50 bill may be deposited via SST 100. As such, SST 100 would update note stack data 108 to reflect that the top note is a $50 bill and the second note in the cassette is a $5 bill. During a subsequent transaction, a user may withdraw $70. The $70 can be dispensed as 3 $20 bills and 1 $10 or as 1 $50 and 1 $20. If the $70 is dispensed as 1 $50 and 1 $20 bill, note stack data 108 may be updated to show the $50 being withdrawn with a one of the $20 withdrawn. As a result, the top notes in the cassette may be $5-$10-$10-$20-$10-$20, etc. The $70 can be dispensed as 3 $20 bills and 1 $10 or as 1 $50 and 1 $20. If the $70 is dispensed as 3 $20 and 1 $10 bill, note stack data 108 may be updated to show the 3 $20 being withdrawn with a one of the $10 withdrawn. As a result, the top notes in cassette may be $5-$50-$10-$10-$10-$10-$20-$10, etc.

Transaction data 110 may include information related to the various transactions executed by SST 100. For example, transaction data 110 may include user data such a credit/debit card information, a username, personal identification number (PIN), etc. Transaction data 110 may also include amounts deposited and withdrawn using SST 100 and how the amounts were deposited or dispensed. For example, transaction data 110 may include that 3 $20 bills were dispensed during a first transaction and 1 $100 bill and 1 $50 bill were deposited during a subsequent transaction.

As disclosed herein, transaction data 110 may be used as a check on note stack data 108. For example, when a cassette is installed it may have contained 250 $20 bills and 250 $10 bills. Transaction data 110 may include information that X number of $20 bills have been withdrawn from the cassette and Y $10 bills have been deposited to the cassette. Note stack data 108 should then show that the number of $20 bills in the cassette is 250-X and the number of $10 bills in the cassette is 250+Y. If note stack data 110 does not show this, then a fault may be triggered. The fault may result in the cassette being taken out of service and other cassettes within SST 100 being used. The fault may also result in an error message being transmitted so that SST 100 may be serviced and the cassette inspected or replaced.

User interface 112 can include any number of devices that allow a user to interface with SST 100. Non-limiting examples of user interface 112 include a keypad, a microphone, a display (touchscreen or otherwise), etc.

Communications port 114 may allow SST 100 to communicate with various information sources and devices, such as, but not limited to, payment processing systems, remote computing devices associated banks or merchants, mobile devices of users, etc. Non-limiting examples of communications port 114 include, Ethernet cards (wireless or wired), Bluetooth® transmitters and receivers, near-field communications modules, etc.

I/O device 116 may allow SST 100 to receive and output information. Non-limiting examples of I/O device 116 include, a camera (still or video), a printer, a scanner, etc. For example, I/O device 116 may include a camera that may be used to capture an image of a user using SST 100. I/O device 116 may also include a printer that can be used to print customer receipts, error logs/messages for technicians, etc.

Figure 2:
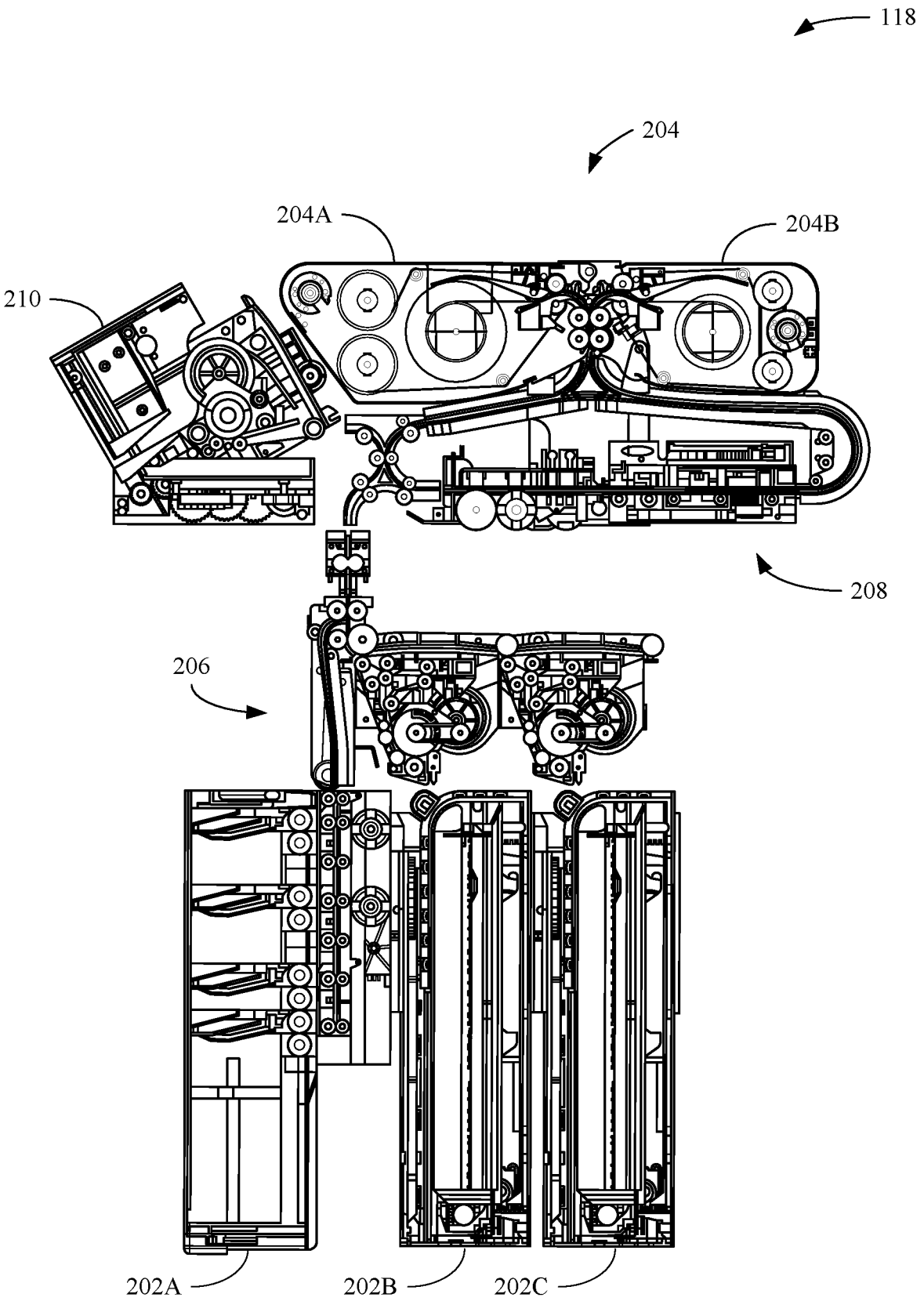
FIG. 2 shows an example media handler consistent with this disclosure.

FIG. 2 shows media handler 118. Media handler 118 may include cassettes 202A, 202B, and 202C (collectively cassettes 202), a large escrow 201A, a temporary escrow 204B (collectively escrow 204), a transport system 206, a bill validator 208, and a dispenser 210. During use, a user may use user interface 112 to deposit various denominations of currency. As an example, for this disclosure, the top 5 notes in cassette 202C may be, in this order, $10-$20-$20-$5-$50.

During a deposit, the user may deposit 1 $10 bill, 2 $20 bills, and 1 $100 bill. The various bills may be feed into dispenser 210, which may also be a media receiver, in the following order $10-$20-$100-$20. During the deposit, the bills may travel from dispenser 210 to escrow 204. The bills may be stored in escrow 204 until the transaction is complete or the bills may be processed from escrow 204 as they are received.

From escrow 204, the bills may pass to bill validator 208. Bill validator 208 may perform multiple functions. For example, bill validator 208 may determine the denomination of each note. For instance, bill validator 208 may determine that the notes deposited were $10-$20-$100-$20. This information may be stored in transaction data 110 and note stack data 108.

Once the denomination of the notes is determined the bills may be sent to one of cassettes 202. For example, the bills may be stored in cassette 202C in the following order: $10-$20-$20-$100. To arrange the bills in this order the $10 bill and the first $20 may be stored in large escrow 204A. The $100 bill may be stored in temporary escrow 204B while the second $20 bill is transferred to and stored in large escrow 204A. Once the $10 bill and $20 bills are in large escrow 204A, the $100 bill may be transferred to large escrow 204A. Once all of the bills are in large escrow 204A, the bills may then be transferred to cassette 202C and transaction data 110 and note stack data 108 updated accordingly.

While above example shows the notes being stored within cassette 202C, the notes may also be stored in cassette 202B. In addition, a first subset of the notes may be stored in cassette 202C and a second subset of the notes may be store in cassette 202B. For instance, the $10 bill and the $20 bills may be stored in cassette 202B and the $100 bill may be stored in cassette 202C.

In addition to determining the denomination of each bill, bill validator 208 may also determine if the notes are valid currency. Stated another way, bill validator 208 may determine if notes are genuine currency or counterfeit currency. In addition, bill validator 208 may determine if a bill meets standards set by a financial institution for acceptance. For example, if less than half of the bill is present, then bill validator 208 may reject the bill. As such, the bill may be stored in temporary escrow 204B while other bills are deposited into dispenser 210. Once all of the bills have been accepted, the bill(s) that fail to meet the acceptance standard may be fed from temporary escrow 204B back to dispenser 210 and rejected to the user.

In addition, bills that are thought to be counterfeit may be stored in temporary escrow 204B and instead of returned to the user may be deposited into cassette 202A. Cassette 202A may be a deposit only cassette. In other words, media deposited into cassette 202A may not be recycled while media deposited into cassettes 202C and 202C may be recycled as disclosed herein. Notes that are found to be counterfeit may later be turned over to authorities along with transaction data 110 for investigation. Notes that are thought to be counterfeit, but later determined to be genuine notes, by be loaded into cassettes 202B or 202C for distribution and the customer's account credited appropriately.

During a dispensing operation, SST 100 may dispense, for example, $200. The $200 may be dispensed as 10 $20 bills or 5 $20 bills and 1 $100 bill. The 10 notes in cassette 202B may be 10 $20 bills and the top five notes in cassette 202C may be, in this order, $10-$20-$20-$100-$10. The customer may have requested that the $200 be dispensed as 5 $20 bills and 1 $100 bill.

To dispense the $200 as requested by the customer, SST 100 may first transfer the $10 bill from cassette 202C to temporary escrow 204B. The 2 $20 bills in cassette 202C may then be transferred to large escrow 202A. 2 more $20 bills may be transferred from cassette 202B to large escrow 202A. The $100 bill now at the top of cassette 202C also may be transferred to large escrow 204A. Once the $100 bill is transferred to large escrow 204A, the $200 may be dispensed to the customer and the $10 bill in temporary escrow 202B may be transferred to cassette 202B or 202C and transaction data 110 and note stack data 108 updated accordingly.

As disclosed herein, notes can be stored in cassettes 202 in any order and in any denominations. Because notes can be transferred between cassettes, there is no need for a dedicated cassette to house a particular denomination. For example, if cassette 202C has an overabundance of $20 bills and cassette 202 does not have any $20 bills, then some of the $20 bills in cassette 202C can be transferred to cassette 202B. For instance, if the top 100 bills in cassette 202C are $20 bills then during a maintenance routine or other downtime, some of the $20 bills may be transferred to temporary escrow 204B or large escrow 204A. While the $20 bills are store in escrow 204, some of the bills from cassette 202B may be transferred to cassette 202C and the $20 bills may then be transferred from escrow 204 to cassette 202B. Once the transfer is complete note stack data 108 and transaction data 110 may be updated accordingly.

During deposits, withdrawals, or just moving notes from one cassette to another, transport system 206 may be used to transport notes between cassettes 202 and bill validator 208 and escrow 204. Thus, as disclosed herein, cassettes 202 allow for various currency notes of differing denominations to be recycled and then dispensed with other notes of differing denominations. The recycled notes (i.e., notes deposited by customers and later dispensed) may be mixed with non-recycled notes (i.e., notes loaded into cassettes 202 by the bank).

Figure 3:
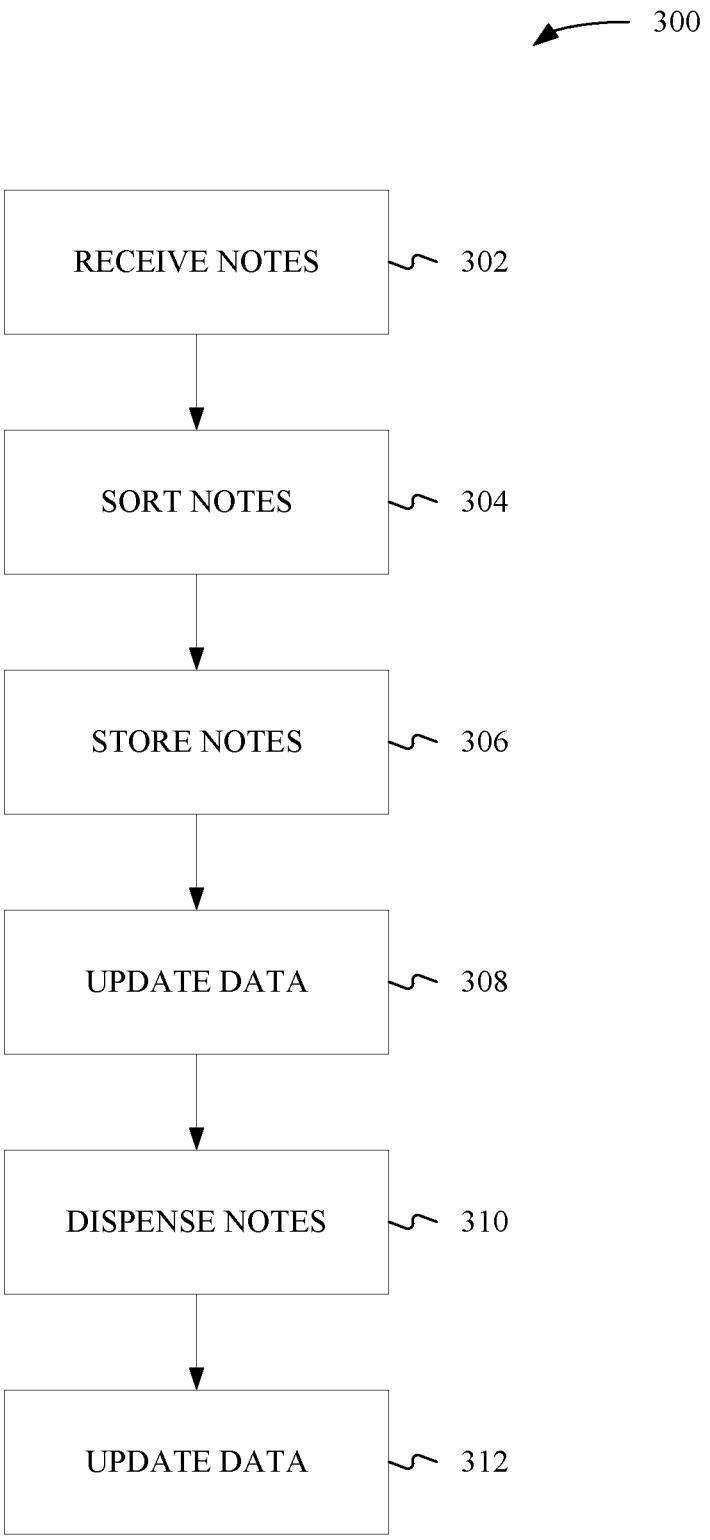
FIG. 3 shows an example method consistent with this disclosure.

FIG. 3 shows an example method 300 for recycling currency. The method 300 may begin at stage 302 wherein a plurality of notes may be received. For example, at stage 302 one or more notes having different denominations may be received at SST 100. As disclosed herein, the plurality of notes may be received at the dispenser 210.

From stage 302 method 300 may proceed to stage 304 where the notes may be sorted. For example, the notes may be sorted by denomination. For instance, as disclosed herein, the notes may be received in a random order and SST 110 may use media handler 118 to sort the notes into a predetermined order. The predetermined order may be from smallest denomination to largest denomination. The predetermined order may also be from largest denomination to smallest denomination.

From stage 304 method 300 may proceed to stage 306 where the notes may be stored in cassettes 200. For example, once sorted the notes may be stored in cassette 202C. While method 300 includes a sort stage, the notes do not have to be sorted before storage. For instance, the notes may be received and stored in cassettes 202 without being sorted.

From stage 306 method 300 may proceed to stage 308 where transaction data 110 and note stack data 108 may be updated. Regardless of whether the notes are sorted or not, bill validator 208 may determine the denomination of each note and update transaction data 110 and note stack data 108. The data can be updated as each note's denomination is determined or as each note is transferred to cassettes 202.

From stage 308 method 300 may proceed to stage 310 where one or more notes may be dispensed. Dispensing of the notes may include SST 100 receiving a request for a withdrawal. The request for the withdrawal may include a listing of particular denominations to be dispensed. For example, a user may want to withdraw $150 in the following denominations: 1 $100 bill, 2 $20 bills, and 1 $10 bill. As such, various notes may be transferred from cassettes 202 to escrow 204 as described above. The various notes may be transferred to escrows 204 so that the desired denomination of notes may be located in large escrow 204A and then can be dispensed via dispenser 210. Any notes stored in the temporary escrow 204B may then be returned to cassettes 202.

From stage 310 method 300 may proceed to stage 312 where the transaction data 110 and note stack data 108 may be updated. As disclosed herein, once notes are dispensed, transaction data 110 and note stack data 108 may be updated to show the new order of notes within cassettes 200.

As disclosed herein, the denomination of notes stored in cassettes 202 may be adjusted dynamically. For example, a particular denomination, such as the $20 bill, may be the most commonly used note. As such, one of cassettes 202 may become saturated with $20 bills. As a result, SST 100 may transfer notes between cassettes 202 to evenly distribute notes between cassettes 202. In addition, cassettes 202 may include more than three cassettes as shown in FIG. 1. For example, four cassettes may be included in SST 100. One of the cassettes may originally be left empty when installed. During operation of SST 100, processing unit 102 may dynamically assign denominations to the empty cassette. In another example, during use, cassettes 202B and 202C may be dynamically assigned to hold only $10 and $20 bills and a fourth cassette not shown may be dynamically assigned to hold $50 and $100 bills. Stated another way, during use processing unit 102, in conjunction with software module 106, may dynamically adjust which and how many notes are stored in the various cassettes 202 to optimize operation of SST 100.

EXAMPLES

Example 1 is a method for recycling currency, the method comprising: receiving, at a self-service terminal, a plurality of currency notes; sorting, by the self-service terminal, the plurality of currency notes by denomination; and dispensing, by the self-service terminal, a subset of the plurality of currency notes.

In Example 2, the subject matter of Example 1 optionally includes storing the plurality of currency notes in a plurality of cassettes.

In Example 3, the subject matter of Example 2 optionally includes dynamically adjusting which of the plurality of cassettes is used to store the plurality of currency notes.

In Example 4, the subject matter of any one or more of Examples 1-3 optionally include escrowing at least one of the plurality of currency notes prior to dispensing the subset of the plurality of currency notes.

In Example 5, the subject matter of any one or more of Examples 1-4 optionally include escrowing a non-recycled currency note prior to dispensing the subset of the plurality of currency notes.

In Example 6, the subject matter of any one or more of Examples 1-5 optionally include wherein dispensing the subset of the plurality of currency notes includes mixing the subset of plurality of currency notes with at least one non-recycled currency note.

In Example 7, the subject matter of any one or more of Examples 1-6 optionally include wherein dispensing the subset of the plurality of currency notes includes dispensing a requested currency amount comprising at least the subset of the plurality of currency notes.

Example 8 is a self-service terminal comprising: a processor; and a memory storing instructions that, when executed by the processor, cause the processor to: receive a denomination for each of a plurality of currency notes, transmit a sort order for the plurality of currency notes by denomination to a media handler; and transmit, to a currency dispenser, a dispense order for a subset of the plurality of currency notes.

In Example 9, the subject matter of Example 8 optionally includes wherein the instructions, when executed by the processor, further cause the processor to store in the memory which one of a plurality of cassettes the plurality of currency notes are stored in.

In Example 10, the subject matter of Example 9 optionally includes wherein the instructions, when executed by the processor, further cause the processor to dynamically adjust which of the plurality of cassettes is used to store the plurality of currency notes.

In Example 11, the subject matter of any one or more of Examples 8-10 optionally include wherein the instructions, when executed by the processor, further cause the processor to transmit, to an escrow unit, escrow instructions to store at least one of the plurality of currency notes prior to the subset of the plurality of currency notes being dispensed.

In Example 12, the subject matter of any one or more of Examples 8-11 optionally include wherein the instructions, when executed by the processor, further cause the processor to transmit, to an escrow unit, escrow instructions to escrow a non-recycled currency note prior to dispensing the subset of the plurality of currency notes.

In Example 13, the subject matter of any one or more of Examples 8-12 optionally include wherein the instructions, when executed by the processor, further cause the processor to generate the dispense order such that the dispense order includes the subset of the plurality of currency notes mixed with at least one non-recycled currency note.

In Example 14, the subject matter of any one or more of Examples 8-13 optionally include wherein the instructions, when executed by the processor, further cause the processor to generate the dispense order such that the dispense order includes a requested currency amount comprising at least the subset of the plurality of currency notes.

Example 15 is a self-service terminal comprising: a plurality of cassettes; a media handler coupled to the plurality of cassettes, the media handler configured to: sort a plurality of currency notes by denomination, and transfer at least one of the plurality of currency notes to one of the plurality of cassettes based on a denomination of the at least one of the plurality of currency notes; and a currency dispenser configured to dispense a subset of the plurality of currency notes, the plurality of currency notes received from at least one of the plurality of cassettes.

In Example 16, the subject matter of Example 15 optionally includes an escrow unit coupled to the plurality of cassettes and the media handler, the escrow component configured to escrow at least one currency note of the plurality of currency notes.

In Example 17, the subject matter of Example 16 optionally includes wherein the at least one currency note is escrowed prior to being stored in one of the plurality of cassettes.

In Example 18, the subject matter of any one or more of Examples 16-17 optionally include wherein the at least one currency note is escrowed prior to being dispensed by the currency dispenser.

In Example 19, the subject matter of any one or more of Examples 15-18 optionally include wherein each of the plurality of cassettes is configured to store multiple denominations of currency.

In Example 20, the subject matter of any one or more of Examples 15-19 optionally include wherein each of the plurality of cassettes is configured to dynamically store multiple denominations of currency.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

The invention claimed is:

1. A method for recycling currency, the method comprising:

receiving, at a self-service terminal, a plurality of currency notes;

sorting, by the self-service terminal, the plurality of currency notes by denomination;

escrowing, by the self-service terminal, at least a first one and a second one of the plurality of currency notes, wherein escrowing the at least the first one and the second one of the plurality of currency notes includes:

storing the first one of the plurality of currency notes in a temporary escrow, storing the second one of the plurality of currency notes in a large escrow, and transferring the first one of the plurality of currency notes to the large escrow;

after escrowing the first one and the second one of the plurality of currency notes, dispensing, by the self-service terminal, a subset of the plurality of currency notes; and updating, by the self-service terminal, note stack data, the note stack data listing the denominations of each currency note stored in a cassette of the self-service terminal.

2. The method of claim 1, further comprising storing the plurality of currency notes in a plurality of cassettes.

3. The method of claim 2, further comprising dynamically adjusting which of the plurality of cassettes is used to store the plurality of currency notes.

4. The method of claim 1, further comprising escrowing a non-recycled currency note prior to dispensing the subset of the plurality of currency notes.

5. The method of claim 1, wherein dispensing the subset of the plurality of currency notes includes mixing the subset of plurality of currency notes with at least one non-recycled currency note.

6. The method of claim 1, wherein dispensing the subset of the plurality of currency notes includes dispensing a requested currency amount comprising at least the subset of the plurality of currency notes.

7. A self-service terminal comprising:

a processor; and a memory storing instructions that, when executed by the processor, cause the processor to:

receive a denomination for each of a plurality of currency notes, transmit a sort order for the plurality of currency notes by denomination to a media handler, transmit, to an escrow unit, escrow instructions to store at least a first one and a second one of the plurality of currency notes, wherein the escrow instructions cause the escrow unit to:

store the first one of the plurality of currency notes in a temporary escrow, store the second one of the plurality of currency notes in a large escrow, and transfer the first one of the plurality of currency notes to the large escrow;

after escrowing, and prior to a subset of the plurality of currency notes being dispensed, transmit, to a currency dispenser, a dispense order for a subset of the plurality of currency notes, and update note stack data, the note stack data listing the denominations of each currency note stored in a cassette of the self-service terminal.

8. The self-service terminal of claim 7, wherein the instructions, when executed by the processor, further cause the processor to store in the memory which one of a plurality of cassettes the plurality of currency notes are stored in.

9. The self-service terminal of claim 8, wherein the instructions, when executed by the processor, further cause the processor to dynamically adjust which of the plurality of cassettes is used to store the plurality of currency notes.

10. The self-service terminal of claim 7, wherein the instructions, when executed by the processor, further cause the processor to transmit, to the escrow unit, escrow instructions to escrow a non-recycled currency note prior to dispensing the subset of the plurality of currency notes.

11. The self-service terminal of claim 7, wherein the instructions, when executed by the processor, further cause the processor to generate the dispense order such that the dispense order includes the subset of the plurality of currency notes mixed with at least one non-recycled currency note.

12. The self-service terminal of claim 7, wherein the instructions, when executed by the processor, further cause the processor to generate the dispense order such that the dispense order includes a requested currency amount comprising at least the subset of the plurality of currency notes.

13. A self-service terminal comprising:

a plurality of cassettes;

a media handler coupled to the plurality of cassettes, the media handler configured to:

sort a plurality of currency notes by denomination, and transfer at least one of the plurality of currency notes to one of the plurality of cassettes based on a denomination of the at least one of the plurality of currency notes;

a currency dispenser configured to dispense a subset of the plurality of currency notes, the plurality of currency notes received from at least one of the plurality of cassettes;

an escrow unit coupled to the plurality of cassettes and the media handler, the escrow component including a large escrow and a temporary escrow configured to escrow at least one currency note of the plurality of currency notes; and a processor configured to update note stack data, the note stack data listing the denominations of each currency note stored in each of the plurality of cassettes, the processor transmitting, to the escrow unit, escrow instructions to store at least a first one and a second one of the plurality of currency notes, wherein the escrow instructions cause the escrow unit to:

store the first one of the plurality of currency notes in the temporary escrow, store the second one of the plurality of currency notes in the large escrow, and transfer the first one of the plurality of currency notes to the large escrow;

after escrowing, and prior to the subset of the plurality of currency notes being dispensed, transmitting, to the currency dispenser, a dispense order for a subset of the plurality of currency notes.

14. The self-service terminal of claim 13, wherein the at least one currency note is escrowed prior to being stored in one of the plurality of cassettes.

15. The self-service terminal of claim 13, wherein the at least one currency note is escrowed prior to being dispensed by the currency dispenser.

16. The self-service terminal of claim 13, wherein each of the plurality of cassettes is configured to store multiple denominations of currency.

17. The self-service terminal of claim 13, wherein each of the plurality of cassettes is configured to dynamically store multiple denominations of currency.

* * * * *